US009623994B2

(12) United States Patent
Roberts et al.

(10) Patent No.: US 9,623,994 B2
(45) Date of Patent: Apr. 18, 2017

(54) PIVOTING HOLD-DOWN DEVICE FOR USE WITH AN APPARATUS FOR MANUFACTURING A PACKAGE

(71) Applicant: Exopack LLC, Spartanburg, SC (US)

(72) Inventors: David Lee Roberts, Hamilton, OH (US); Michael J. Douglas, Fremont, WI (US)

(73) Assignee: COVERIS FLEXIBLES US LLC, Chicago, IL (US)

( * ) Notice: Subject to any disclaimer, the term of this patent is extended or adjusted under 35 U.S.C. 154(b) by 0 days.

(21) Appl. No.: 14/156,194

(22) Filed: Jan. 15, 2014

(65) Prior Publication Data

US 2014/0196404 A1 Jul. 17, 2014

Related U.S. Application Data

(60) Provisional application No. 61/753,361, filed on Jan. 16, 2013.

(51) Int. Cl.
*B65B 51/10* (2006.01)
*B65B 45/00* (2006.01)
*B65B 7/06* (2006.01)

(52) U.S. Cl.
CPC ..... *B65B 51/10* (2013.01); *B65B 45/00* (2013.01); *B65B 7/06* (2013.01)

(58) Field of Classification Search
CPC B25B 5/04; B25B 5/145; B25B 5/163; B25B 5/166; B25B 7/20; B25B 1/04; B25B 1/02; B25B 1/20; B25B 1/22; B25B 5/101; B25B 5/109; B25B 5/125; B25B 5/003; B25B 5/14; B65B 57/02; B65B 51/10; B65B 45/00
USPC ..... 269/166, 126, 163, 43, 139, 140, 141, 269/147, 148, 219, 256, 6, 143; 248/64; 15/185
See application file for complete search history.

(56) References Cited

U.S. PATENT DOCUMENTS 2,525,204 A * 10/1950 Calabro ..... B27D 3/00 100/214
4,427,191 A * 1/1984 Hess ..... B27M 3/0053 269/128
4,456,043 A * 6/1984 Stocks ..... B23Q 9/0042 144/136.95
4,552,345 A * 11/1985 Benda ..... B25B 5/003 269/113
4,747,588 A * 5/1988 Dillhoff ..... B25B 5/12 269/258
4,795,141 A * 1/1989 Mulvaney ..... 269/41
7,854,035 B2 * 12/2010 Gullicks et al. ..... 15/147.1
(Continued)

*Primary Examiner* — Joseph J Hail
*Assistant Examiner* — J Stephen Taylor
(74) *Attorney, Agent, or Firm* — Stoel Rives LLP

(57) ABSTRACT

The present disclosure relates to a hold-down device for use in the packaging industry. For example, the hold-down may be used with an apparatus for manufacturing a package. The hold-down may be configured to retain a packaging structure during the evacuation and/or sealing steps of a packaging process. The hold-down may include an elongate member and an attachment assembly. The elongate member may be configured to pivot and/or rotate about its longitudinal axis in response to a force exerted on the packaging structure during an evacuation and/or sealing step of a packaging process.

20 Claims, 7 Drawing Sheets

(56) References Cited

U.S. PATENT DOCUMENTS

2003/0025261 A1* 2/2003 Anton ..... B25B 5/145
269/126

* cited by examiner

PIVOTING HOLD-DOWN DEVICE FOR USE WITH AN APPARATUS FOR MANUFACTURING A PACKAGE

CROSS-REFERENCE TO RELATED APPLICATIONS

This patent application claims priority to U.S. Provisional Patent Application No. 61/753,361 entitled PIVOTING HOLD-DOWN DEVICE FOR USE WITH AN APPARATUS FOR MANUFACTURING A PACKAGE, filed Jan. 16, 2013, which is incorporated herein by reference in its entirety.

TECHNICAL FIELD

The present disclosure is generally directed to a pivoting hold-down device for use in the packaging industry.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

Figure 1:
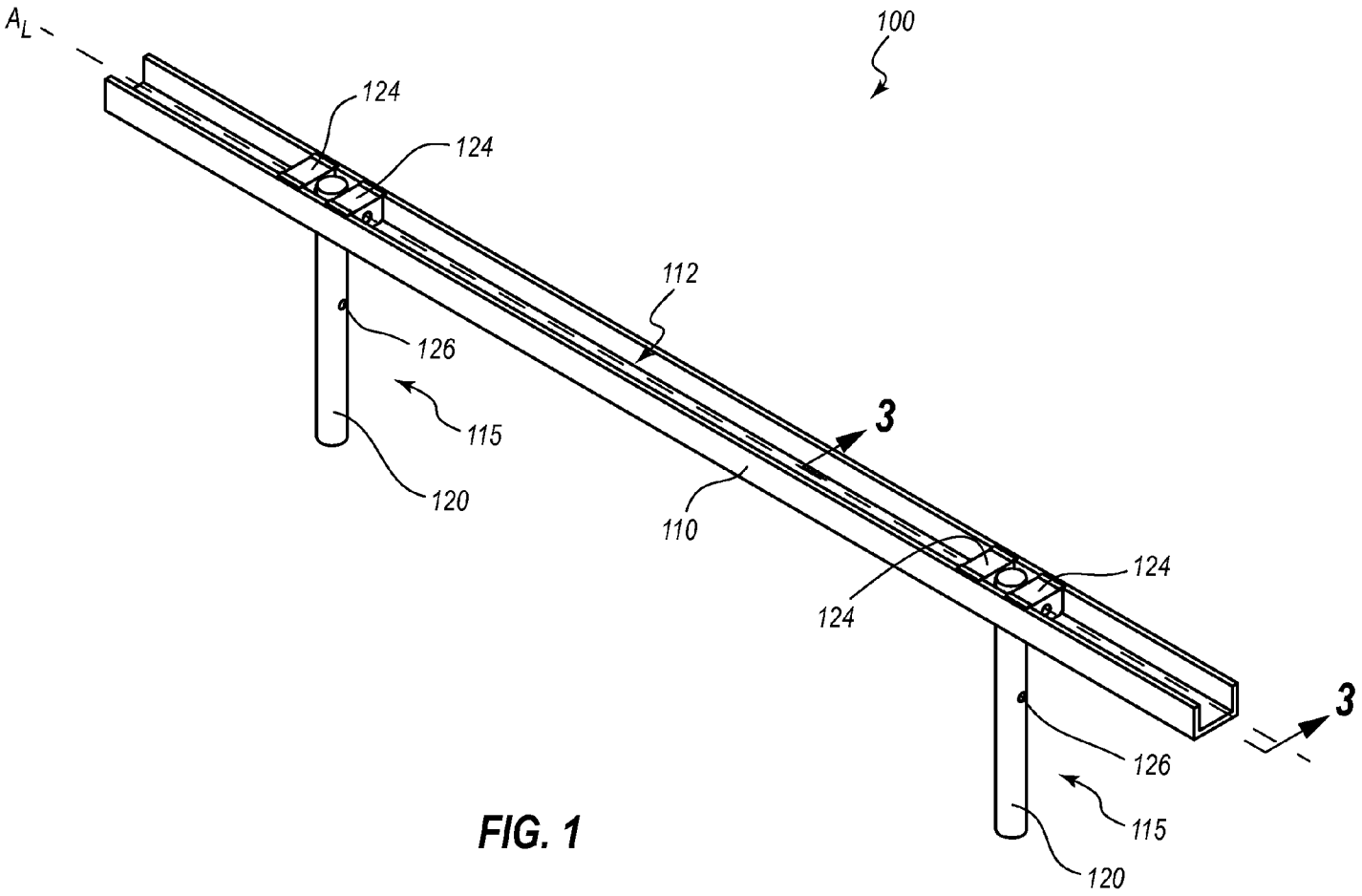
FIG. 1 is a perspective view of a hold-down device, according to an embodiment of the present disclosure.

The embodiments of the present disclosure are generally directed to hold-down devices that may be used in the packaging industry. Hold-down devices, such as the hold-down devices disclosed herein, may be used in a packaging apparatus to hold, pinch, or otherwise retain packaging structures during various packaging steps. For example, hold-down devices may be used to hold the packaging structure in place during the evacuation and/or sealing steps of a packaging process.

A relatively large amount of force may be exerted on the packaging structure during the evacuation and/or sealing steps of a packaging process. This force can cause the packaging structure to slip and move from its retained position between one or more hold-down devices. The slipping and/or moving of the packaging structure is commonly known as packaging pull back. Packaging pull back may result in the packaging being sealed incorrectly and may require manufacturing rework. For example, the seal may be formed over the top of, or behind, the evacuation holes.

The force exerted on the packaging structure during the evacuation and/or sealing steps may also damage the packaging apparatus. For example, as the packaging structure is pulled away from its retained position, an undesirable amount of force may be applied to the hold-down device that is being used to retain the packaging structure. This force may cause the springs that attach the hold-down device to the packaging apparatus to bend and/or break. Replacing the damaged springs may be expensive and time-consuming. The force may also cause additional damage to the packaging apparatus.

The disclosed hold-down devices may minimize the problems caused by the forces exerted on the packaging structure during the evacuation and/or sealing steps. For example, the disclosed hold-down devices are capable of pivoting and/or rotating about their longitudinal axis. By pivoting and/or rotating, the hold-down devices are capable of minimizing and eliminating the problems associated with packaging pull back. For example, as the force and tension on the packaging structure is increased thereby pulling the packaging structure away from its retained position, the hold-down device may pivot and/or rotate. By pivoting and/or rotating, the pressure between one or more hold-down devices may increase resulting in a tightened grip on the packaging structure and minimizing pull back. By pivoting and/or rotating, the hold-down device is also capable of minimizing and eliminating damage caused to the packaging apparatus as there is a decreased dependence on the one or more springs that may couple the hold-down device to the packaging apparatus.

The embodiments disclosed herein may be best understood by reference to the drawings, wherein like parts are designated by like numerals throughout. It will be readily understood that the components of the present disclosure, as generally described and illustrated in the drawings herein, could be arranged and designed in a wide variety of different configurations. Thus, the following more detailed description of the embodiments of the apparatus is not intended to limit the scope of the disclosure, but is merely representative of possible embodiments of the disclosure. While the various aspects of the embodiments are presented in drawings, the drawings are not necessarily drawn to scale unless specifically indicated. In some cases, well-known structures, materials, or operations are not shown or described in detail.

The phrases "connected to," "coupled to," and "in communication with" refer to any form of interaction between two or more entities, including but not limited to mechanical, electrical, magnetic, electromagnetic, fluid, and thermal interaction. Two components may be coupled to each other even though they are not in direct contact with each other. For example, two components may be coupled to each other through an intermediate component.

Figure 2:
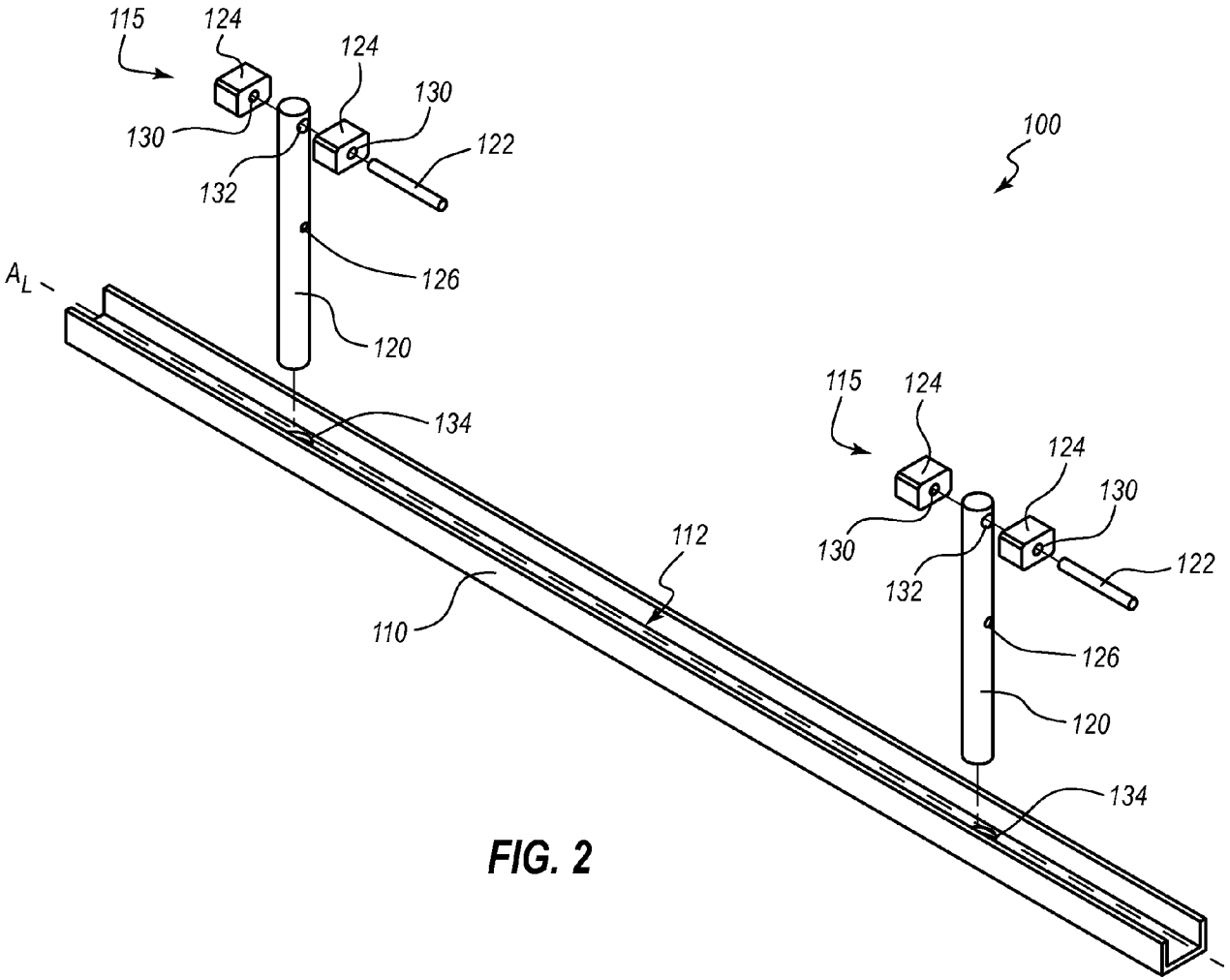
FIG. 2 is an exploded perspective view of the hold-down device of FIG. 1.

FIGS. 1-2 are views of a hold-down device 100, according to the present disclosure. Specifically, FIG. 1 is a perspective view of a hold-down device 100, and FIG. 2 is an exploded perspective view of the hold-down device 100 of FIG. 1, illustrating the individual components of the hold-down device 100. As shown in FIGS. 1-2, the hold-down device 100 may comprise an elongate member 110 and an attachment assembly 115. The attachment assembly 115 may comprise a post 120, a fastener 122, and one or more fastener blocks 124.

The elongate member 110 may be configured such that it extends along a longitudinal axis $A_L$. The elongate member 110 may be substantially linear. In some embodiments, the elongate member 110 may be configured such that it comprises a channel 112.

The channel 112 may extend in the direction of the longitudinal axis $A_L$ of the elongate member 110. The channel 112 may vary in length. For example, in some embodiments, the channel 112 may extend along the entire length of the elongate member 110. In other embodiments, the channel 112 may extend along only a portion of the length of the elongate member 110.

The shape of the elongate member 110 may vary. In some embodiments, the elongate member 110 may be substantially U-shaped when viewed along a transverse cross-section. In other embodiments, the elongate member 110 may be substantially V-shaped when viewed along a transverse cross-section. In other embodiments, the elongate member 110 may be substantially cylindrical in shape. In yet other embodiments, the elongate member 110 may be substantially rectangular in shape.

In some embodiments, an elastomeric member may be coupled to the elongate member 110. The elastomeric member may comprise one or more polymeric materials. The polymeric material may be relatively stiff. The elastomeric member may be coupled inside of the channel 112 of the elongate member 110. In some embodiments, the elastomeric member may be configured such that it extends from the inside of the channel 112 to the outside of the channel 112.

In some embodiments, the elongate member 110 may comprise one or more apertures 134. Each aperture 134 may extend through the elongate member 110. For example, each aperture 134 may extend through the bottom of the channel 112. As described in more detail below, in some embodiments, a post 120 of an attachment assembly 115 may be configured to extend through an aperture 134 in the elongate member 110.

The elongate member 110 may be made of a variety of materials. In some embodiments, the elongate member 110 may comprise a metal. For example, the elongate member 110 may comprise stainless steel.

The elongate member 110 may be made in a variety of ways. In some embodiments, the elongate member 110 may be made from a single piece of material. For example, forming the elongate member 110 may comprise cutting and removing material from a substantially rectangular block of material to form the channel 112. In other embodiments, individual pieces may be coupled together to form the elongate member 110. For example, three individual pieces may be coupled together to form a substantially U-shaped elongate member 110.

The length of the elongate member 110 may vary. For example, in some embodiments, the length of the elongate member 110 may be between about 8 inches and about 16 inches. In other embodiments, the length of the elongate member 110 may be between about 10 inches and about 14 inches. In yet other embodiments, the length of the elongate member 110 may be about 12 inches. The elongate member 110 may be longer, or shorter, as desired.

As previously mentioned, the hold-down device 100 may comprise an attachment assembly 115. In some embodiments, the hold-down device 100 may comprise a plurality of attachment assemblies 115. For example, the hold-down device 100 illustrated in FIGS. 1-2 comprises two attachment assemblies 115. The attachment assembly 115 may comprise a post 120, a fastener 122, and one or more fastener blocks 124. In some embodiments, for example, each attachment assembly 115 may comprise a post 120, a fastener 122, and a first and second fastener block 124. As shown in FIGS. 1-2, a first end of the post 120 may be coupled to the elongate member 110 via the fastener 122 and one or more fastener blocks 124.

The post 120 may be coupled to the elongate member 110 in such a way that the elongate member 110 may be configured to pivot and/or rotate about its longitudinal axis $A_L$ while the post 120 may remain stationary. In some embodiments, for example, the elongate member 110 may be configured to rotate about its longitudinal axis $A_L$ between about 5° and about 50° in each direction. In other embodiments, the elongate member 110 may be configured to rotate about its longitudinal axis $A_L$ between about 15° and about 40° in each direction. In other embodiments, the elongate member 110 may be configured to rotate about its longitudinal axis $A_L$ between about 20° and about 35° in each direction. In other embodiments, the elongate member 110 may be configured to rotate about its longitudinal axis $A_L$ between about 25° and about 30° in each direction.

The post 120 may be coupled to the elongate member 110 via the fastener 122 and one or more fastener blocks 124 in a variety of ways. For example, the post 120 may comprise an aperture 132 through which the fastener 122 may extend. The one or more fastener blocks 124 may also comprise an aperture 130 through which the fastener 122 may extend. By extending through the aperture 132 of the post 120, and the aperture 130 in one or more fastener blocks 124, the fastener 122 may couple the post 120 to the elongate member 110.

The shape and size of the post 120 may vary. In some embodiments, the post 120 may be substantially cylindrical in shape. In other embodiments, the post 120 may be substantially rectangular. Other shapes may also be used.

Any variety of fasteners 122 may be used in the present disclosure. For example, in some embodiments, the fastener 122 may comprise a pin that may be cylindrically shaped. In other embodiments, the fastener 122 may comprise a bolt. In other embodiments, the fastener 122 may comprise a screw.

The one or more fastener blocks 124 may be coupled to the inside of the channel 112 of the elongate member 110. For example, in some embodiments the one or more fastener blocks 124 may be welded to the inside of the channel 112. In other embodiments, the one or more fastener blocks 124 may be glued or adhered to the inside of the channel 112. In other embodiments, the one or more fastener blocks 124 may be soldered to the inside of the channel 112. In yet other embodiments, the one or more fastener blocks 124 may be integral with the elongate member 110. In some embodiments, the one or more fastener blocks 124 may be fixedly attached to the inside of the channel 112 of the elongate member 110.

The attachment assembly 115 may also be configured to couple the elongate member 110 to a packaging apparatus, or a housing of a packaging apparatus. As shown in FIGS. 1-2, the post 120 may extend from the elongate member 110 in a direction that is substantially perpendicular to the longitudinal axis $A_L$ of the elongate member 110. In some embodiments, the post 120 may extend through an aperture 134 in the elongate member 110.

The second end of the post 120 may be configured to be coupled to a packaging apparatus. The post 120 may couple to the packaging apparatus in a variety of ways. In some embodiments, the post 120 may be configured to be coupled to the packaging apparatus via a spring. For example, as shown in FIGS. 1-2, the post 120 may comprise an aperture 126 that may be used to couple the post 120 to the packaging apparatus via a spring. Other ways of attaching the post 120 to the packaging apparatus may also be used.

Figure 3:
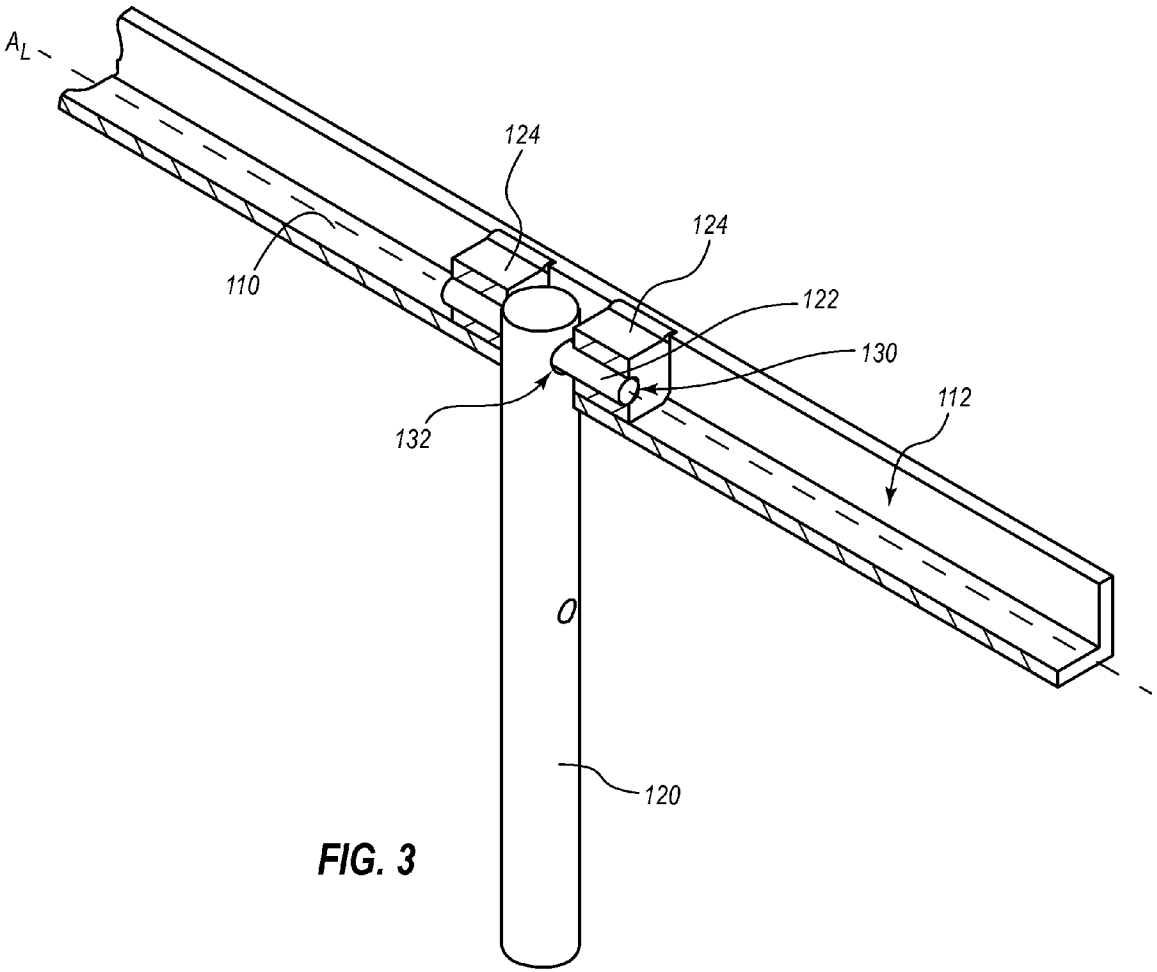
FIG. 3 is a cross-sectional view of a portion of the hold-down device of FIG. 1, taken along the view line 3-3 in FIG. 1.

FIG. 3 is a cross-sectional view of a portion of the hold-down device 100 of FIG. 1 illustrating a manner in which the post 120 may be coupled to the elongate member 110 via the fastener 122 and one or more fastener blocks 124. As shown in FIG. 3, the one or more fastener blocks 124 may be coupled inside the channel 112 of the elongate member 110 such that the aperture 130 of the one or more fastener blocks 124 may be oriented parallel to the longitudinal axis $A_L$ of the elongate member 110.

As further shown in FIG. 3, the fastener 122 may be disposed such that it extends through an aperture 130 in a first fastener block 124, through an aperture 132 in the post 120, and through an aperture 130 in a second fastener block 124. In the illustrated embodiment, the fastener 122 may be disposed such that it is parallel to and/or aligned with the longitudinal axis $A_L$ of the elongate member 110. By being coupled in this manner, the elongate member 110 may be capable of pivoting and/or rotating about its longitudinal axis $A_L$.

Figure 5:
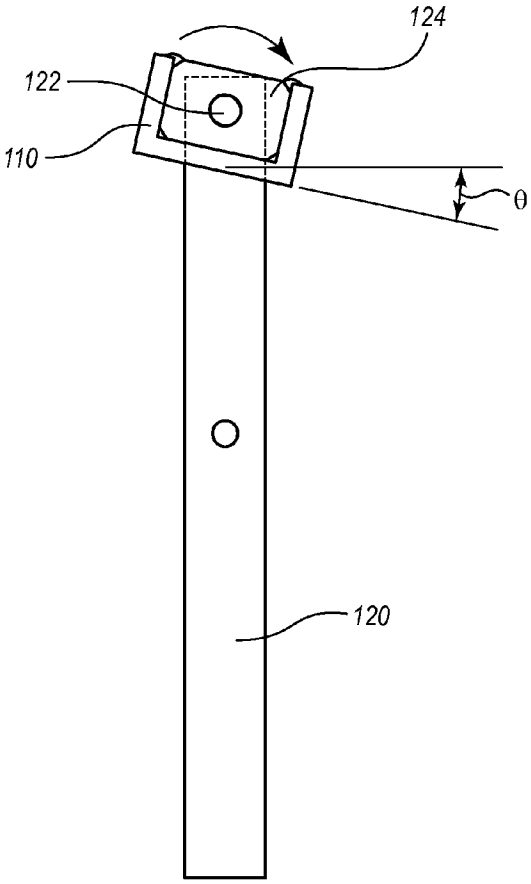
FIG. 5 is an end view of the hold-down device of FIG. 1.
Figure 4:
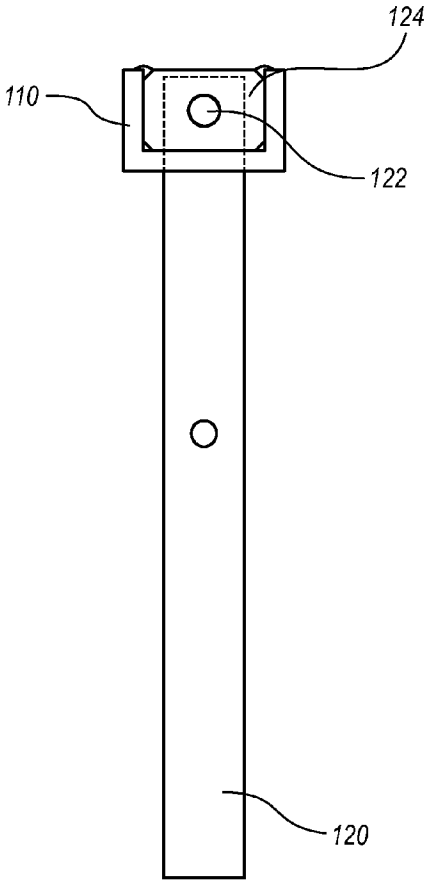
FIG. 4 is an end view of the hold-down device of FIG. 1.

FIGS. 4-5 are end views of the hold-down device 100 of FIG. 1. As shown in FIG. 4, the post 120 may be coupled to the elongate member 110 via the fastener 122 and one or more fastener blocks 124 such that it extends from the elongate member 110 in a direction that is substantially perpendicular to the elongate member 110. As shown in FIG. 5 the elongate member 110 may be capable of pivoting and/or rotating about its longitudinal axis clockwise to a position that is at an angle θ when viewed from a transverse cross-section or an end view. Likewise, the elongate member 110 may be capable of pivoting and/or rotating about its longitudinal axis counterclockwise to a substantially similar position in the opposite direction. In some embodiments, the elongate member 110 may be capable or rotating clockwise (or counterclockwise) to a position wherein the angle θ is between about 5° and about 50°. In other embodiments, the elongate member 110 may be capable or rotating clockwise (or counterclockwise) to a position wherein the angle θ is between about 15° and about 40°. In other embodiments, the elongate member 110 may be capable or rotating clockwise (or counterclockwise) to a position wherein the angle θ is between about 20° and about 35°. In other embodiments, the elongate member 110 may be capable or rotating clockwise (or counterclockwise) to a position wherein the angle θ is between about 25° and about 30°.

Figure 6:
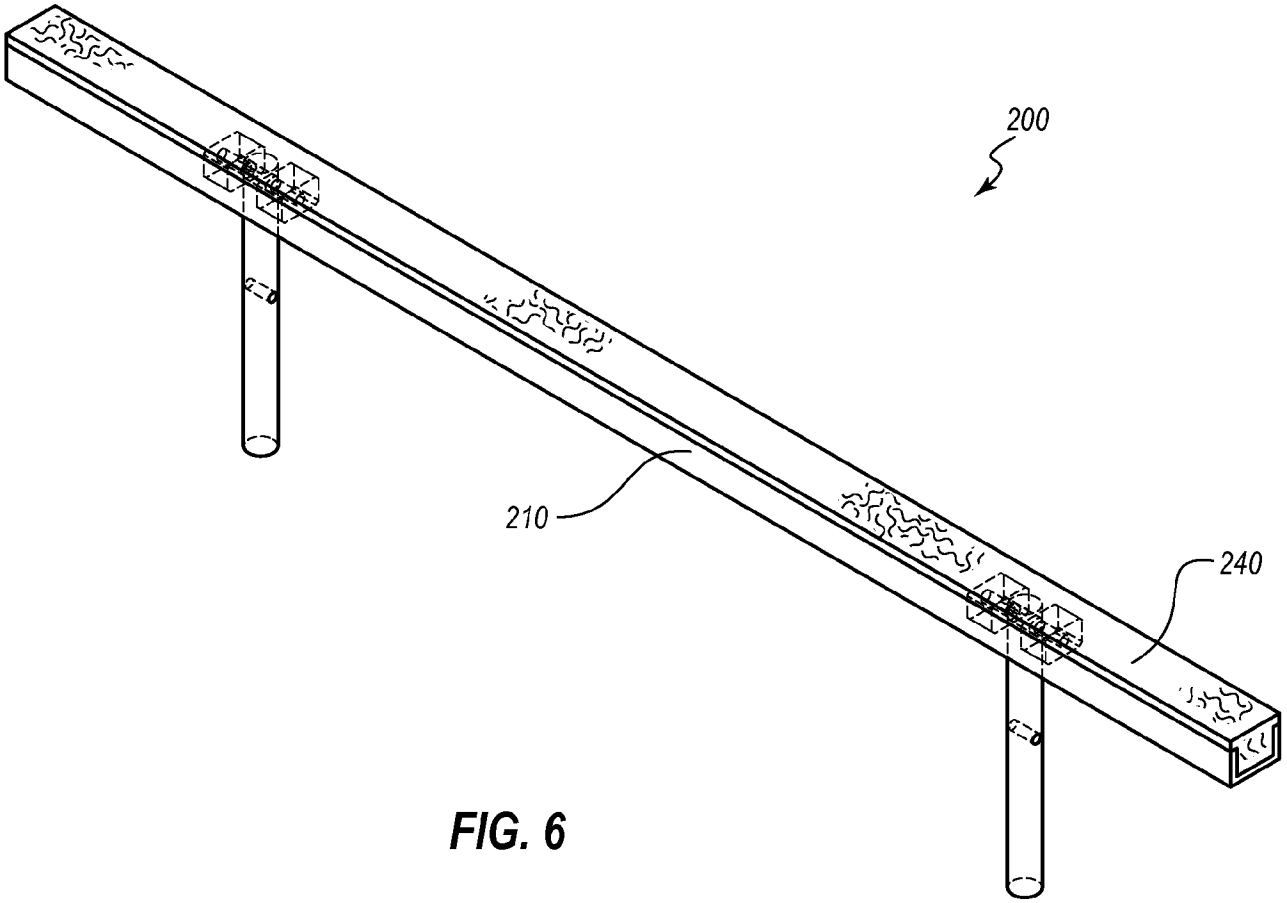
FIG. 6 is a perspective view of a hold-down device, according to an embodiment of the present disclosure.

FIG. 6 is a perspective view of a hold-down device 200, according to another embodiment of the present disclosure. The hold-down device 200 can, in certain respects, resemble components of the hold-down device described in connection with FIGS. 1-5 above. It will be appreciated that all the illustrated embodiments may have analogous features. Accordingly, like features are designated with like reference numerals, with the leading digits incremented to "2." (For instance, the hold-down device is designated "100" in FIGS. 1-5, and an analogous hold-down device is designated as "200" in FIG. 6.) Relevant disclosure set forth above regarding similarly identified features thus may not be repeated hereafter. Moreover, specific features of the hold-down device and related components shown in FIG. 6 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the hold-down device of FIG. 6. Any suitable combination of the features, and variations of the same, described with respect to the hold-down device 100 and components illustrated in FIGS. 1-5, can be employed with the hold-down device 200 and components of FIG. 6, and vice versa. This pattern of disclosure applies equally to further embodiments depicted in subsequent figures and described hereafter.

As shown in FIG. 6, the hold-down device 200 may further comprise an elastomeric member 240 coupled to the elongate member 210. The elastomeric member 240 may extend beyond the channel of the elongate member 210. The elastomeric member 240 may extend the entire length of the elongate member 210. In other embodiments, the elastomeric member 240 may extend along only a portion of the length of the elongate member 210. The elastomeric member 240 may provide the hold-down device 200 with traction to grip the packaging structure when used to retain the packaging structure.

Figure 7:
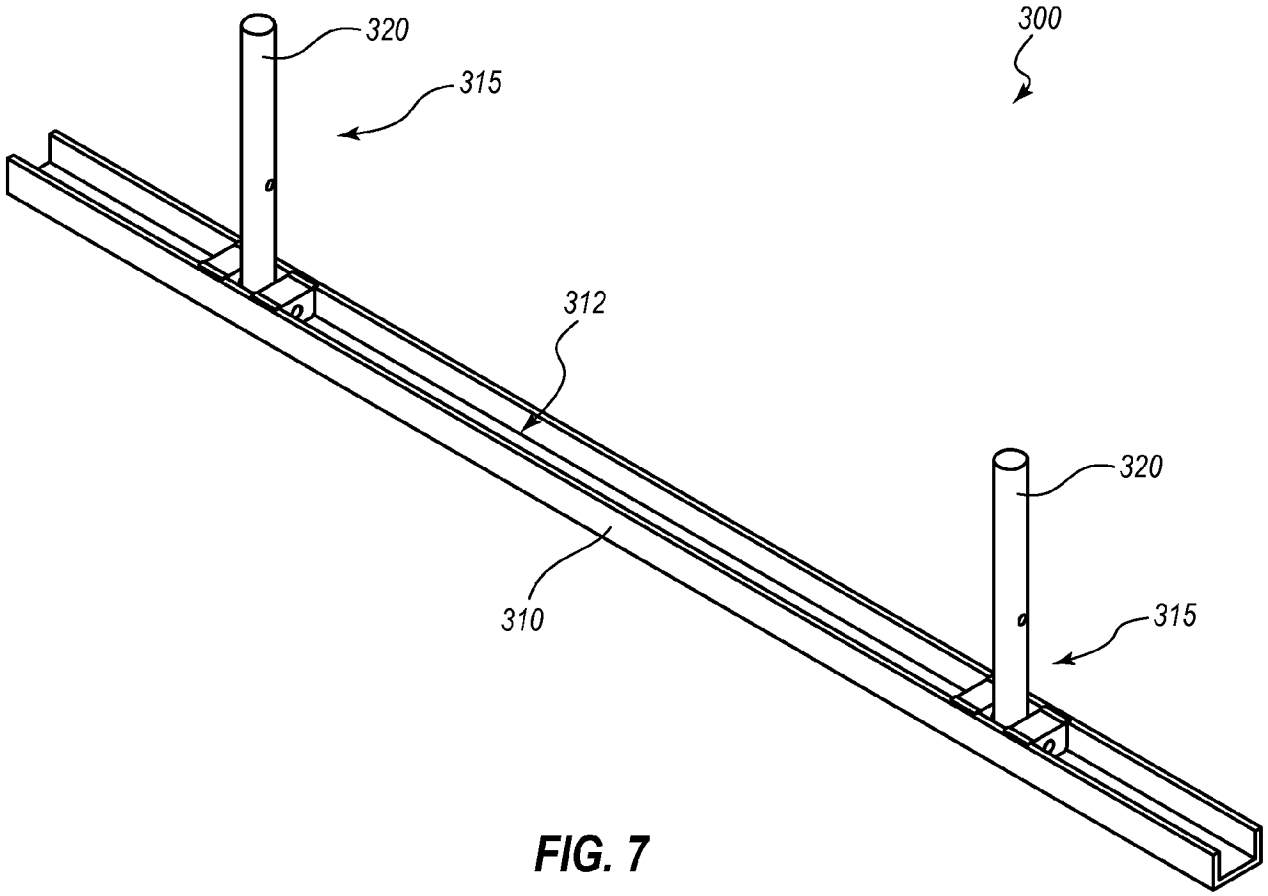
FIG. 7 is a perspective view of a hold-down device, according to an embodiment of the present disclosure.

FIG. 7 is a perspective view of a hold-down device 300, according to another embodiment of the present disclosure. As shown in FIG. 7, in some embodiments, the attachment assembly 315 may be coupled inside the channel 312 of the elongate member 310 such that the post 320 extends outwardly from the channel 312 away from the bottom of the channel 312 rather than extending through an aperture in the elongate member 310 such as shown in FIGS. 1-2.

Figure 8:
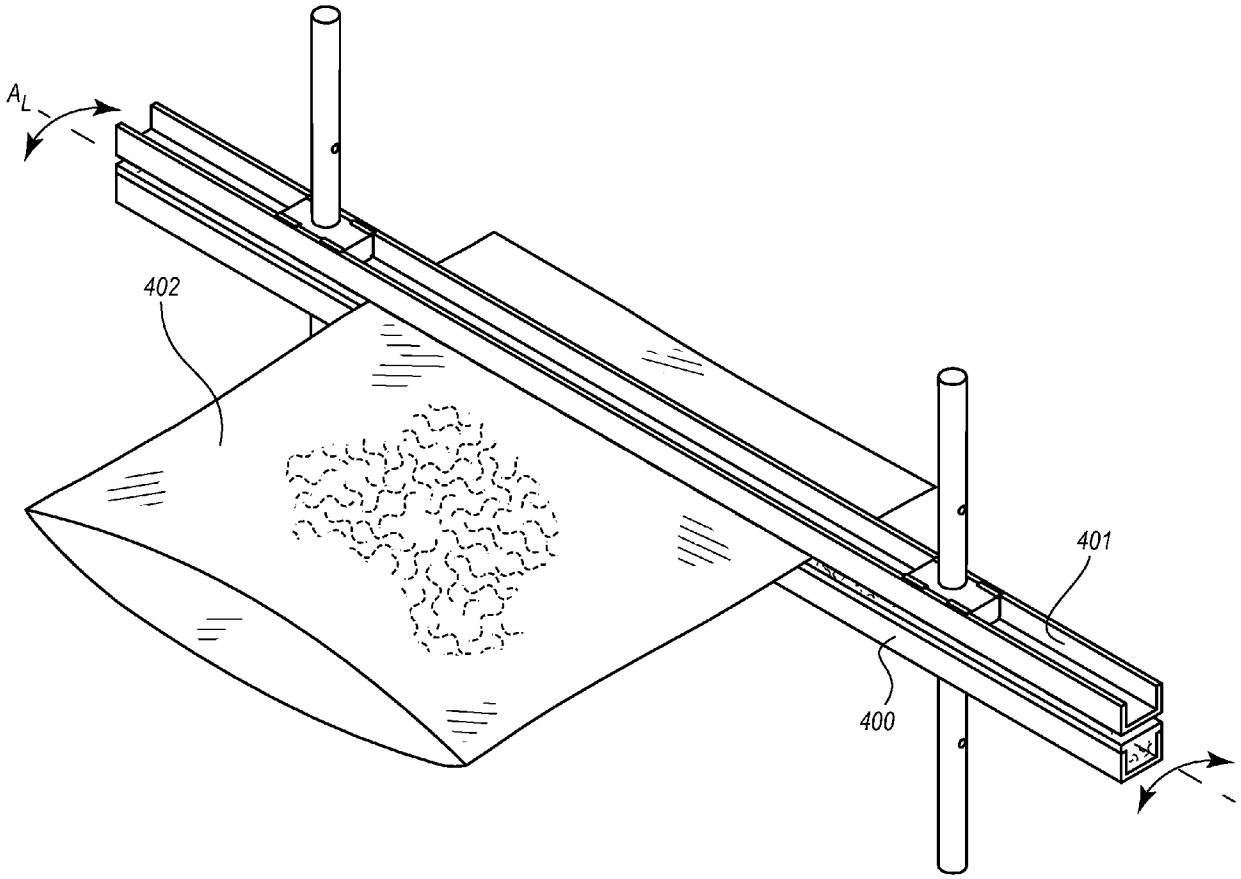
FIG. 8 is a perspective view a hold-down device retaining a packaging structure, according to an embodiment of the present disclosure.

FIG. 8 is a perspective view of a hold-down device 400 retaining a packaging structure 402, according to an embodiment of the present disclosure. The hold-down device 400 may be employed in various packaging apparatuses, such as for example, Cyrovac® Series 8600 Rotary Vacuum Chamber Systems. In some embodiments, the hold-down device 400 may be employed in a Cyrovac® 8600-14 packaging apparatus. In some embodiments, the hold-down device 400 may be utilized in the vacuum chamber of the packaging apparatus. In some embodiments, the hold-down device 400 may be utilized in the rotary chamber of a packaging apparatus.

The hold-down devices 400 disclosed herein may be used for a variety of purposes. For example, the hold-down devices 400 may be used with packaging structures 402 that include polymeric and/or plastic materials. The hold-down devices 400 may be used to hold or retain plastic bags. Exemplary foods that may be packaged with a packaging apparatus that utilizes the hold-down devices 400 disclosed herein include any variety of meats.

As shown in FIG. 8, in some embodiments, the hold-down device 400 may interact with a second hold-down device 401 or other bar, seat or holding device. In some embodiments, both hold-down devices may be of the type disclosed herein, whereas in other embodiments, one hold-down device may be of the type disclosed herein and the second holding device (bar, seat, or hold-down device) may be different. In some embodiments, a packaging apparatus may comprise an upper seat that is stationary and non-pivoting 401 ("upper stationary seat"). The upper stationary seat 401 may be configured to move downward towards the lower hold-down device 400 (the lower hold-down device 400 being of a type disclosed herein). For example, prior to the evacuation and/or sealing steps of a packaging process, the upper stationary seat 401 may move downward towards the lower hold-down device 400, thereby pinching, clamping, or otherwise retaining the packaging structure 402 between the upper stationary seat 401 and the lower hold-down device 400. For example, the upper stationary seat 401 and the lower hold-down device 400 may interact such that the neck of a bag or other packaging structure 402 is pinched, clamped, or otherwise retained between them, as is shown in FIG. 8.

During the evacuation step, the packaging apparatus may be configured to remove air from the packaging structure 402. As the air is removed from the packaging structure 402, forces may be exerted on the packaging structure 402 causing tension on the packaging structure 402. The tension may cause the packaging structure 402 to want to pull away from the upper stationary seat 401 and lower hold-down device 400.

As the tension on the packaging structure 402 increases, the elongate member of the hold-down device 400 may pivot or rotate about its longitudinal axis $A_L$ towards the direction in which the packaging structure 402 is being pulled. The pivoting or rotating of the elongate member of the hold down 400 may increase the force holding the packaging structure 402 between the upper stationary seat 401 and the lower hold-down device 400.

In some embodiments, after the air has been removed from the packaging structure 402, the packaging structure 402 may be sealed. For example, the packaging structure 402 may be heat sealed. In some embodiments, pressure may be applied on the packaging structure 402 during the sealing step. Additionally, in some embodiments, there is a piercing action during either the evacuation and/or sealing steps. The piercing action may also cause pressure to be exerted on the packaging structure 402. As the tension on the packaging structure 402 increases due to the pressure exerted during the evacuation and/or sealing steps, the elongate member of the hold-down device 400 may pivot or rotate about its longitudinal axis $A_L$ towards the direction in which the packaging structure 402 is being pulled. The pivoting or rotating of the elongate member of the hold down 400 may increase the force holding the packaging structure 402 between the upper stationary seat 401 and the lower hold-down device 400. As can be appreciated, in some embodiments, a second hold down 400 of the type disclosed herein may be used in place of the upper stationary seat 401 depicted in FIG. 8.

Methods of retaining a packaging structure using the hold-down devices disclosed herein are also contemplated. For example, the hold-down device may be used to retain a packaging structure during an evacuation and/or sealing step of a packaging process.

References to approximations are made throughout this specification, such as by use of the terms "about" or "approximately." For each such reference, it is to be understood that, in some embodiments, the value, feature, or characteristic may be specified without approximation. For example, where qualifiers such as "about," "substantially," and "generally" are used, these terms include within their scope the qualified words in the absence of their qualifiers. For example, where the term "substantially perpendicular" is recited with respect to a feature, it is understood that in further embodiments, the feature can have a precisely perpendicular configuration.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. The scope of the invention is therefore defined by the following claims and their equivalents.

What is claimed is:

1. A packaging system, comprising:

a first hold-down device comprising:

a first elongate member having a longitudinal axis, wherein the first elongate member is substantially U-shaped along a transverse cross-section; and a first post;

wherein the first elongate member is configured to rotate about its longitudinal axis in response to a force exerted on a packaging structure during an evacuation or sealing step of a packaging process, and wherein the first post is coupled to the first elongate member such that the first post is configured to remain in a fixed position while the first elongate member rotates about its longitudinal axis; and a second hold-down device comprising:

a second elongate member having a longitudinal axis; and a second post.

2. The packaging system of claim 1, wherein the first elongate member of the first hold-down device is configured to rotate about its longitudinal axis in response to a force exerted on the packaging structure during an evacuation step.

3. The packaging system of claim 1, wherein the first elongate member of the first hold-down device is configured to rotate about its longitudinal axis in response to a force exerted on the packaging structure during a sealing step.

4. The packaging system of claim 1, wherein the first elongate member of the first hold-down device is configured to rotate about its longitudinal axis in each of the clockwise and counterclockwise directions to a position that is between about 5 and about 50 degrees.

5. The packaging system of claim 1, wherein the first hold-down device further comprises:

an attachment assembly, wherein the attachment assembly comprises a fastener, and first and second fastener blocks, wherein a first end of the first post is coupled to the first elongate member such that the first post extends from the first elongate member in a direction that is substantially perpendicular to the first elongate member.

6. The packaging system of claim 5, wherein the first and second fastener blocks are coupled within a channel of the first elongate member.

7. The packaging system of claim 5, wherein the fastener is configured to couple the first post to the first and second fastener blocks.

8. The packaging system of claim 5, wherein the first and second fastener blocks each comprise an aperture extending therethrough, and the first end of the first post comprises an aperture extending therethrough, wherein the fastener couples the first post to the first and second fastener blocks by extending at least partially through the aperture in the first fastener block, extending through the aperture in the first end of the first post and extending at least partially through the aperture in the second fastener block.

9. The packaging system of claim 5, wherein the first hold-down device further comprises a second attachment assembly and another post.

10. The packaging system of claim 1, wherein the first post is substantially cylindrical in shape.

11. The packaging system of claim 1, wherein the first elongate member is approximately 12 inches long.

12. The packaging system of claim 1, wherein the first hold-down device further comprises an aperture extending through the first elongate member, and wherein the first post extends through the aperture.

13. The packaging system of claim 1, wherein the first hold-down device further comprises an elastomeric member that is coupled to the first elongate member.

14. A hold-down device for use in an apparatus for manufacturing a package, comprising:

an elongate member having a longitudinal axis, wherein the elongate member comprises stainless steel;

a first attachment assembly, wherein the first attachment assembly comprises a first post, a first fastener, and first and second fastener blocks, wherein a first end of the first post is coupled to the elongate member such that the first post extends from the elongate member in a direction that is substantially perpendicular to the elongate member, wherein the first and second fastener blocks are coupled in a channel of the elongate member;

a second attachment assembly, wherein the second attachment assembly comprises a second post, a second fastener, and third and fourth fastener blocks, wherein a first end of the second post is coupled to the elongate member such that the second post extends from the elongate member in a direction that is substantially perpendicular to the elongate member, wherein the third and fourth fastener blocks are coupled in the channel of the elongate member; and an elastomeric member that is coupled to the elongate member;

wherein the elongate member is configured to rotate about its longitudinal axis while each of the first post and the second post remains in a fixed position.

15. The hold-down device of claim 14, wherein the elongate member is configured to rotate about its longitudinal axis in response to a force exerted on a packaging structure during an evacuation or a sealing step of a packaging process.

16. The hold-down device of claim 14, wherein the elongate member is configured to rotate about its longitudinal axis in each of the clockwise and counterclockwise directions to a position that is between about 5 and about 50 degrees.

17. The hold-down device of claim 14, wherein the first post is substantially cylindrical in shape.

18. The hold-down device of claim 14, wherein the elongate member is substantially U-shaped along a transverse cross-section.

19. The hold-down device of claim 14, wherein the first fastener is configured to couple the first post to the first and second fastener blocks.

20. The hold-down device of claim 14, wherein the first and second fastener blocks each comprise an aperture extending therethrough, and the first end of the first post comprises an aperture extending therethrough, wherein the first fastener couples the first post to the first and second fastener blocks by extending at least partially through the aperture in the first fastener block, extending through the aperture in the first end of the first post and extending at least partially through the aperture in the second fastener block.

* * * * *